US005478522A

United States Patent [19]

Wang

[11] Patent Number: 5,478,522

[45] Date of Patent: Dec. 26, 1995

[54] METHOD FOR MANUFACTURING HEATING ELEMENT

[75] Inventor: S. Wang, Taipei, Taiwan

[73] Assignee: National Science Council, Taipei, Taiwan

[21] Appl. No.: 340,198

[22] Filed: Nov. 15, 1994

[51] Int. Cl.[6] ..... B22F 3/12; B22F 3/16; B22F 7/00

[52] U.S. Cl. ..... 419/19; 419/26; 419/28; 419/29; 419/30; 419/33; 419/38; 419/53; 419/57

[58] Field of Search ..... 419/10, 19, 28, 419/29, 32, 33, 38, 41, 42, 57, 58

[56] References Cited

U.S. PATENT DOCUMENTS

| | | | |
|---|---|---|---|
| 3,969,278 | 7/1976 | Aksenov et al. | 252/513 |
| 4,069,043 | 1/1978 | Ackermann | 75/232 |
| 4,289,833 | 9/1981 | Hachisuka | 428/544 |
| 4,299,629 | 11/1981 | Haack | 75/251 |
| 4,393,563 | 7/1983 | Smith | 29/149.5 DP |
| 4,464,205 | 8/1984 | Kumar et al. | 148/11.5 P |
| 4,501,717 | 2/1985 | Tsukamoto et al. | 419/58 |
| 4,582,536 | 4/1986 | Raybould | 75/246 |
| 4,587,096 | 5/1986 | Mankins et al. | 419/27 |
| 4,662,939 | 5/1987 | Reinshagen | 75/246 |
| 4,714,586 | 12/1987 | Swarr et al. | 419/2 |
| 4,799,955 | 1/1989 | McClellan | 75/247 |
| 4,954,170 | 9/1990 | Fey et al. | 75/229 |
| 4,964,909 | 10/1990 | Engstrom et al. | 75/246 |
| 5,034,187 | 7/1991 | Sliney et al. | 419/14 |
| 5,298,052 | 3/1994 | Tanaka et al. | 75/243 |
| 5,356,453 | 10/1994 | Takata | 75/244 |
| 5,424,257 | 7/1995 | Schat et al. | 501/127 |

*Primary Examiner*—Donald P. Walsh
*Assistant Examiner*—Scott T. Bluni
*Attorney, Agent, or Firm*—Christie, Parker & Hale

[57] ABSTRACT

The present invention relates to a method for manufacturing a heating element, the method including the steps of: a) providing powders of two metals; b) mixing the powders; c) grinding the mixed powders; d) compacting the mixed powders to form a green compact; e) sintering the green compact in a first atmosphere; f) plastically working and process annealing the green compact; g) etching a surface of the green compact to cause pores thereon; and h) sintering the etched green compact in an oxidizing atmosphere. A Ni-Cr heating element manufactured by the present method has improved high temperature properties and a fusion temperature 300° C. greater than those of conventional Ni-Cr heating elements.

13 Claims, 4 Drawing Sheets

METHOD FOR MANUFACTURING HEATING ELEMENT

FIELD OF THE INVENTION

The present invention is related to a method for manufacturing a heating element, and more particularly to a method for manufacturing a heating element which possesses a high fusion temperature and high-temperature rigidity.

BACKGROUND OF THE INVENTION

Heating elements are widely used in many fields and preferably characterized in having high fusing point, high resistivity and good oxidation-resistant property.

The commonly used materials for heating elements application are classified into four groups: (1) Ni-Cr or Ni-Cr-Fe alloys (2) Fe-Cr-Al alloys, (3) pure metals and (4) nonmetallic heat-element materials. The materials of the first group are most commonly used because they have good ductility and high resistivity and in addition, they can be used within a broad temperature range and in various atmospheres. Although the materials of the second group have a higher resistivity than that of the first group, their tensile strengths are relatively low. In addition, their microstructures become fragile after periodically thermally treated at a high temperature. Furthermore, the heating elements made of the second group become elongated so that their resistance is greatly changed after repeatedly heated. The materials of the third group are not widely applied because of the working atmosphere limitation. As for the materials of the fourth group, silicon carbide is cheap but fragile, graphite has a poor oxidation-resistant property so that it cannot be used at a temperature over 400° C. in an oxidizing atmosphere, and molybdenum disilicide is suitable to be used for heating elements but is too expensive.

A conventional method used for manufacturing a Ni-Cr heating element is the ingot metallurgy technique which includes steps of refining crude metals to form an ingot, plastically working the ingot and manufacturing the desired product from the ingot by way of other further process, e.g. manufacturing a wire by way of wire drawing. So far, the cheapest and the most commonly used Ni-Cr heating element made by the conventional ingot metallurgy consists of 78.5% Ni, 20% Cr and 1.5% Si by weight. This kind of heating element has a microstructure of a solid solution and a fusion temperature of 1400° C. and normally works at a temperature of 1150° C.

SUMMARY OF THE INVENTION

An object of the present invention is to provide a method for manufacturing a heating element which has a fusion temperature higher than 1700° C.

Another object of the present invention is to provide a method for manufacturing a heating element which has a higher high-temperature rigidity at 1400° C. than those ones having approximately the same fusion temperature.

In accordance with the present invention, a method for manufacturing a heating element includes steps of: a) providing powders of two metals, e.g. about 70%~90% Ni and about 30%~10% Cr by weight; b) mixing the powders to obtain mixed powders; c) compacting the mixed powders to form a green compact; and d) sintering the green compact in a first atmosphere. The first atmosphere may be an oxidizing atmosphere, e.g. an air or oxygen atmosphere. The green compact is sintered at a temperature of about 1300 ° C. and a pressure of about 1 atm for about an hour. The method further includes a step of grinding the powders into finer ones preferably in an attritor mill after mixing the powders preferably in a ball mill. The compacting step c) is one of cold isostatic compaction, slip casting, vibratory compaction, continuous compaction, powder rolling compaction, powder extrusion and cold die compaction processes. The heating element manufactured by the present method has a cermet microstructure, a density of about 80% and a fusion temperature over 1700° C. Aside from the aforementioned steps, the first atmosphere may be a nitrogen-hydrogen, argon or argon-hydrogen atmosphere, and the present method further includes after the step d) a step e) of plastically working and process annealing the green compact. The heating element manufactured through plastic working has a density even higher than 95%. The present invention may further include after the step e) steps of: f) etching a surface of the green compact to cause pores thereon, and g) sintering the etched green compact in an oxidizing atmosphere, e.g. an air or an oxygen atmosphere.

The present invention may best be understood through the following description with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purpose of illustration and description only; it is not intended to be exhaustive or to be limited to the precise form disclosed.

Figure 1:
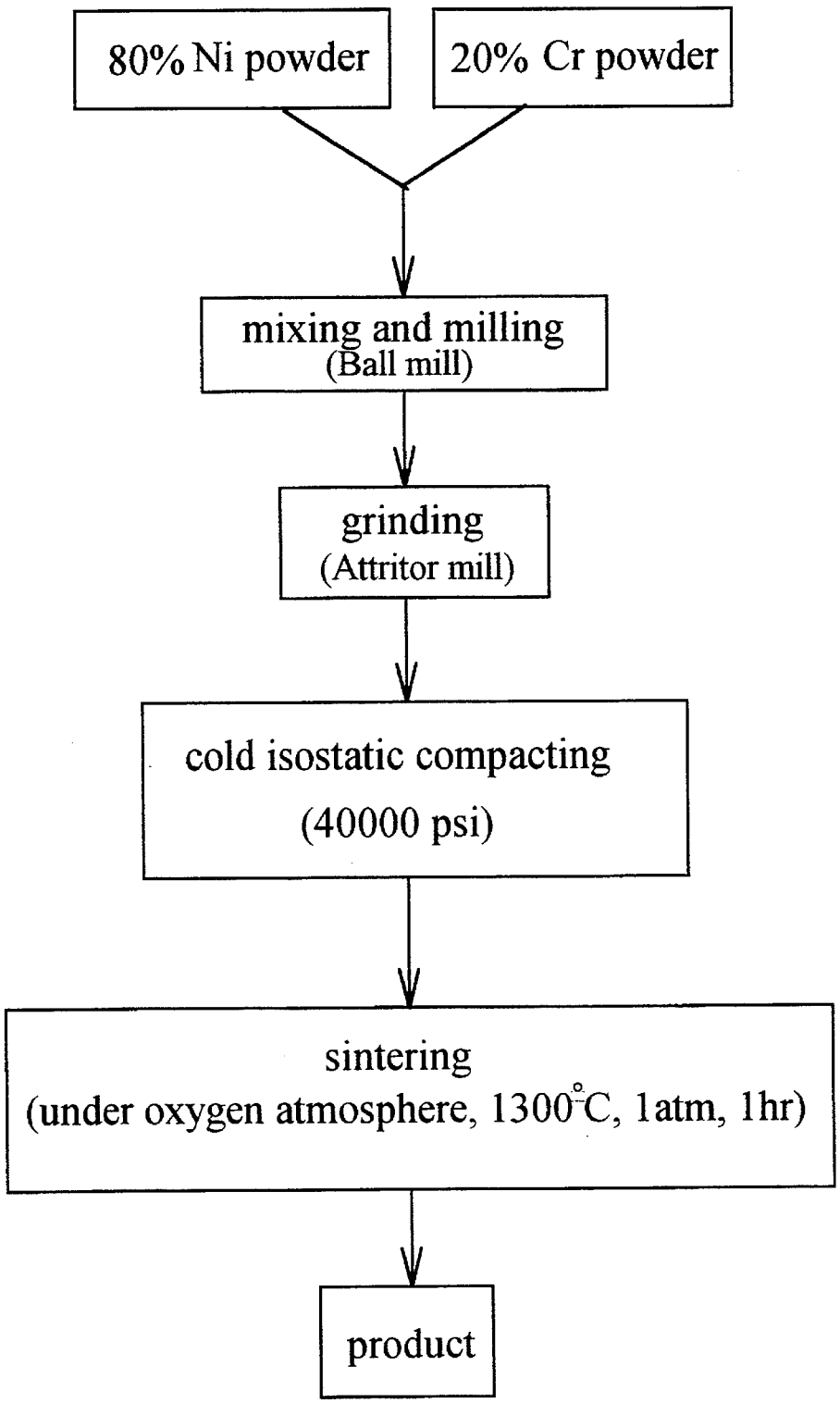
FIG. 1 is a flow chart showing a preferred embodiment of a method for manufacturing a heating element according to the present invention.

Preferred Embodiment 1:

Refer now to FIG. 1 which is a flow chart showing a preferred embodiment of a method for manufacturing a heating element according to the present invention. Powders of 80% nickel and 20% chromium by weight are provided as the raw material for a heating element. The powders are sent into a ball mill to be mixed and milled, and further ground in an attritor mill. The extremely fine powders are then compacted at a pressure of 40,000 psi by way of cold isostatic compaction to form a green compact. The green compact is sintered in an oxygen atmosphere at a temperature of about 1300° C. and a pressure of about 1 atm for about an hour to obtain a cermet-microstructure heating element with a high density of about 80%, which has a high fusion temperature of above 1700° C. and can be used at a working temperature of 1600° C. The calculation of the density is described here. A metal is melted and then solidifies and we define it has a density of D 1. This metal is ground into powder, compacted and then sintered, and we define it has a density of D2. Because there are pores inside and on the surface of the processed metal, the values of the density D2 will be smaller than that of D1, and the result of (D2/D1)×100 is defined to be a density of a metal processed by powder metallurgy.

Preferred Embodiment 2

Figure 2:
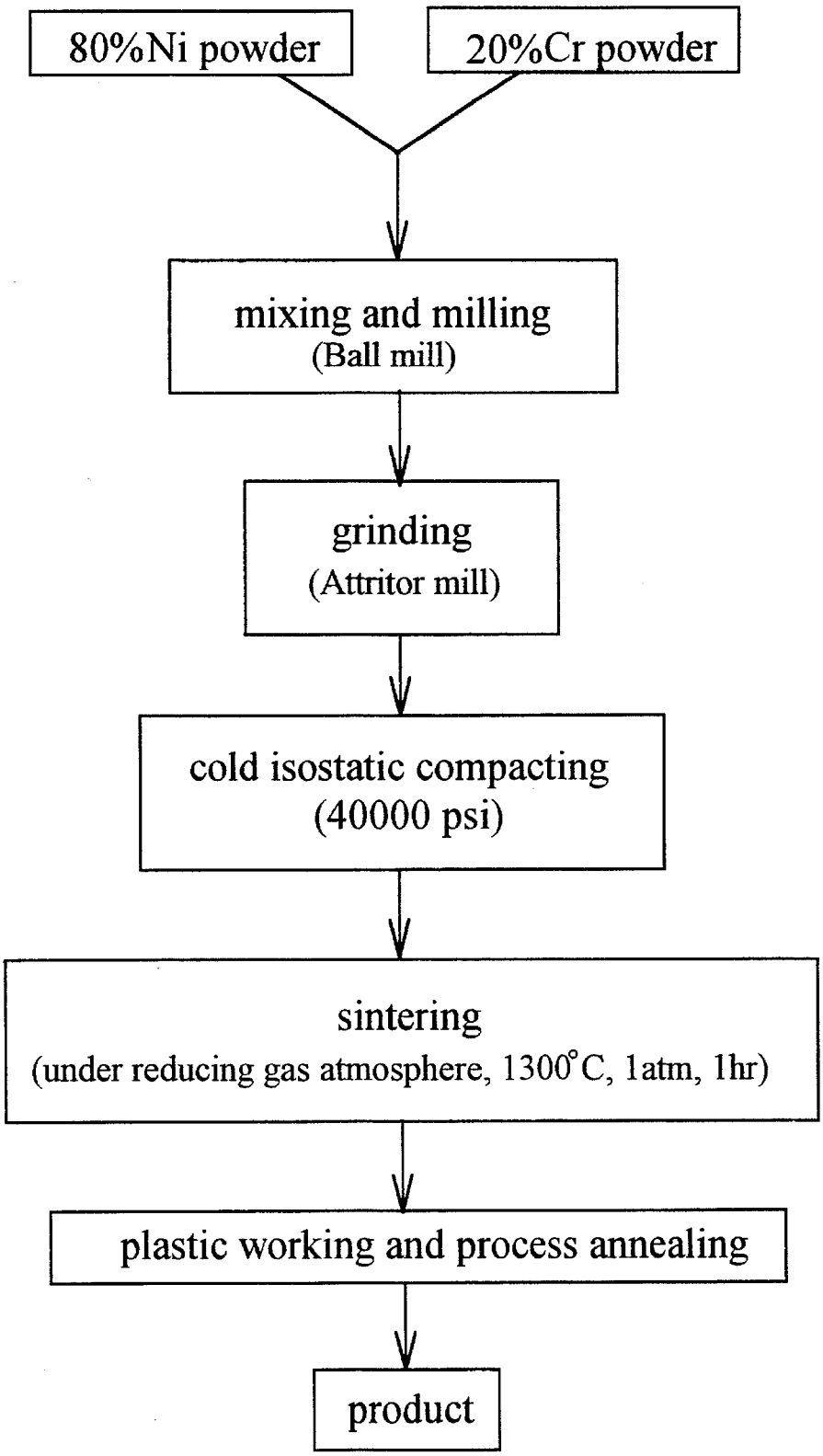
FIG. 2 is a flow chart showing another preferred embodiment of a method for manufacturing a heating element according to the present invention.

Refer now to FIG. 2 which is a flow chart showing another preferred embodiment of a method for manufacturing a heating element according to the present invention. At first, the manufacturing steps are similar to those of the Preferred Embodiment 1. Powders of 80% nickel and 20% chromium by weight are provided as the raw materials for a heating element. The powders are sent into a ball mill to be mixed and milled, and further ground in an attritor mill. The extremely fine powders are then compacted at a pressure of 40,000 psi by way of cold isostatic compaction to :form a green compact. The green compact is sintered in a reducing or inert gas, e.g. nitrogen-hydrogen, argon-hydrogen or argon atmosphere at a temperature of about 1300° C. and a pressure of about 1 atm for about an hour, and then plastically worked and process annealed. The purpose of plastic working and process annealing is to change the microstructure of a metal material, easily shape the material and enhance the density of the material. The material to be plastically worked cannot be sintered in an oxidizing atmosphere because the material sintered in an oxidizing atmosphere cannot be molded in the process of plastically working, and instead, the sintered material will subject to break in the process of plastically working. The property of the plastically worked material will not be changed much if it is sintered in an oxidizing atmosphere after the plastically working process because it can only be oxidized on the surface. The open pores on the surface are closed due to the ironing action during the plastic working steps, so the atmosphere can not penetrate into the interior of the material. Nevertheless the plastically worked material can attain a density over 99% and has good formability. Above all it exhibits good high-temperature rigidity of the ODS (oxide disperse strengthening) materials.

Figure 3:
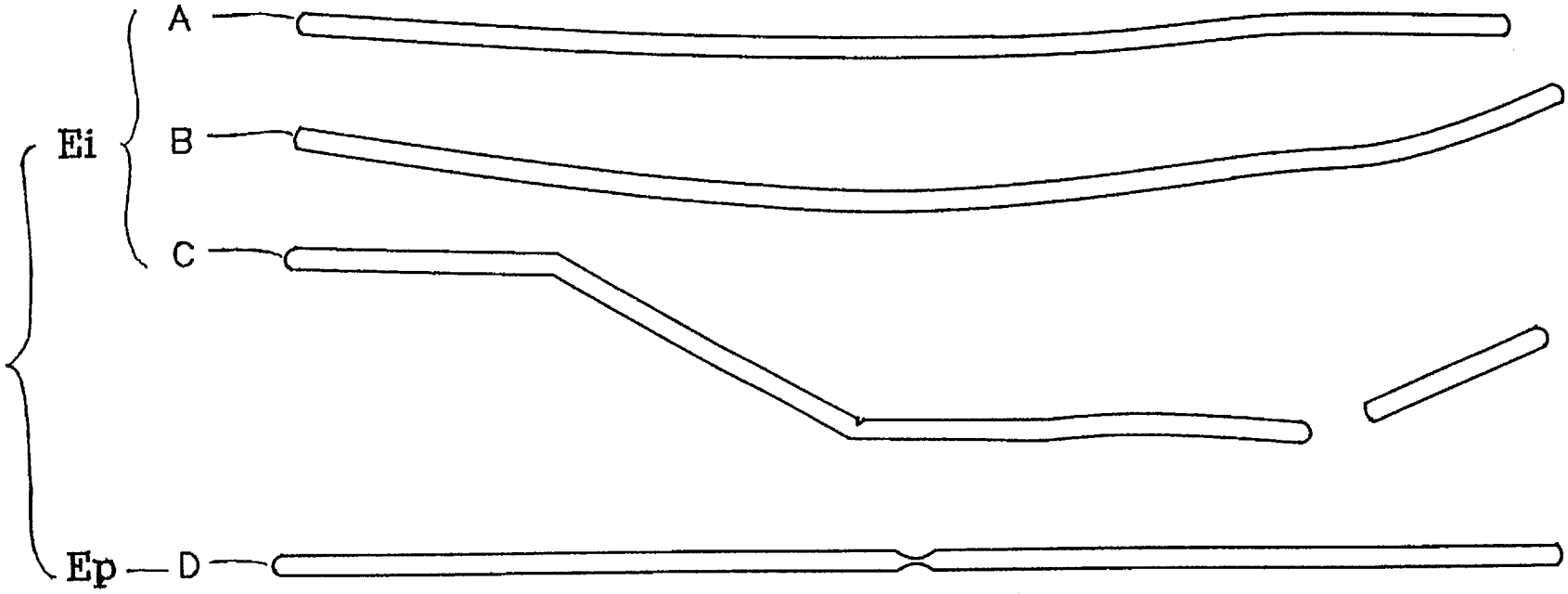
FIG. 3 is a schematic diagram showing the comparisons of the fusion temperatures and fusing states between a conventional heating element and a heating element manufactured by the steps as shown in FIG. 2.

FIG. 3 is a schematic diagram showing the comparisons of the fusion temperatures and fusing states between a conventional heating element with a composition of 78.5% Ni, 20% Cr and 1.5% Si by weight and a heating element manufactured by the present method as shown in FIG. 2. In FIG. 3, Line A schematically represents a commercial heating element Ei that is heated to a temperature of 1200° C. and then cooled, and an initial bending is observed. In FIG. 3, Line B schematically represents the commercial heating element Ei that is heated to 1250° C. and then cooled, and it is observed that the heating element Ei bends more. Finally, at a temperature of 1400° C., the heating element Ei bends greatly and is broken, as schematically shown in Line C of FIG. 3. The present heating element Ep sintered in nitrogen atmosphere is broken at a temperature of 1440° C., as schematically shown in Line D of FIG. 3. The heating element Ep, however, does not bend at all and the break occurs only on a point, as shown by an arrow, so that the heating element Ep is improved to have a better high temperature rigidity.

Preferred Embodiment 3

Figure 4:
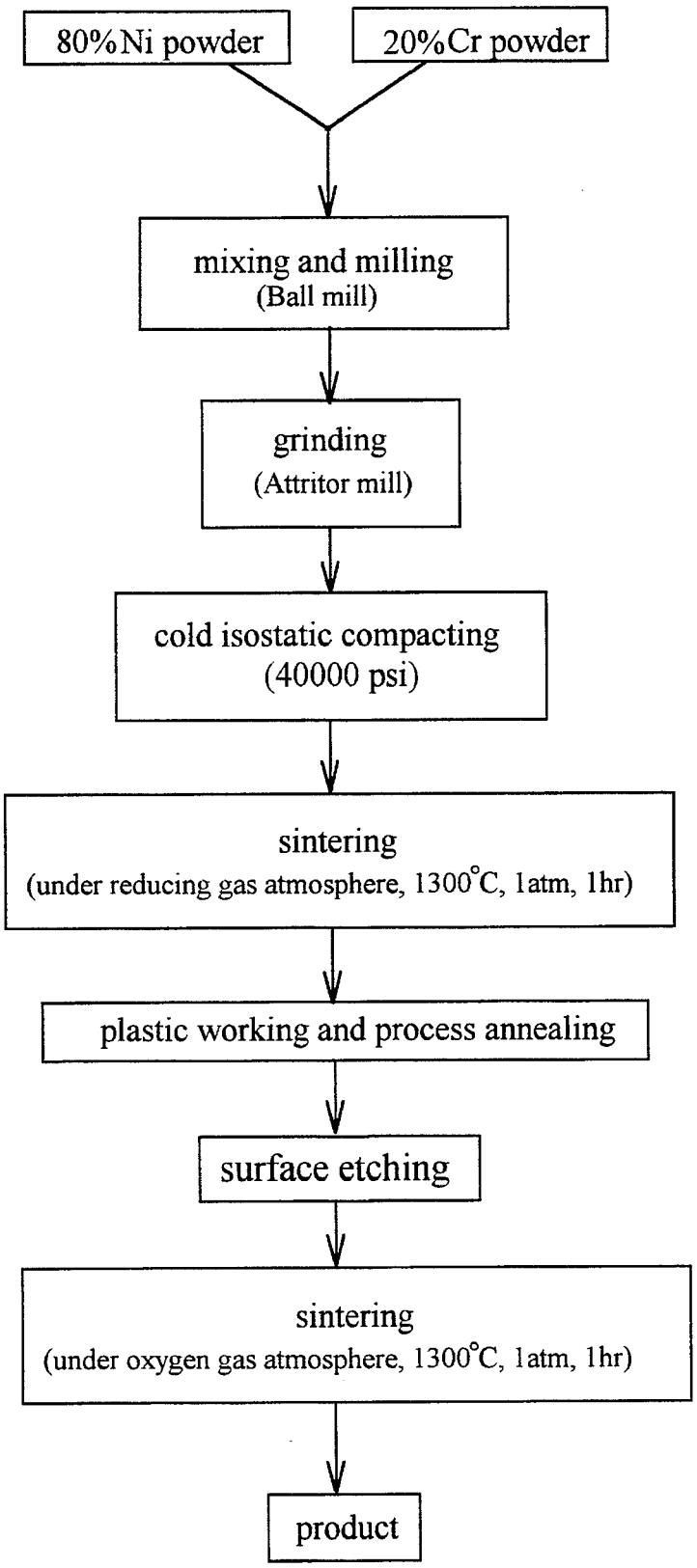
FIG. 4 is a flow chart showing another preferred embodiment of a method for manufacturing a heating element according to the present invention.

Refer now to FIG. 4 which is a flow chart showing another preferred embodiment of a method for manufacturing a heating element according to the present invention. At first, the manufacturing steps are the same as those of the Preferred Embodiment 2. However, in order to have the plastically worked material able to be sintered in an oxidizing atmosphere, the resulting heating element of the Preferred Embodiment 2 is treated by surface etching and then sintered in an oxidizing atmosphere.

To sum up, the heating element manufactured by the Preferred Embodiment of the present method, as shown in FIG. 1, has a fusing temperature at least 300° C. higher than that of the conventional ones. In addition, the money-added value of the conventional 80% Ni and 20% Cr material can therefore be raised. The heating element manufactured by the Preferred Embodiment 2 of the present method, as shown in FIG. 2, has a higher high-temperature rigidity than the conventional one, and therefore can be used at a working temperature higher than 1150° C., or has a longer life at the same working temperature than the conventional one.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for manufacturing a heating element, comprising the steps of:

a) providing powders of two metals;

b) mixing said powders to obtain mixed powders;

c) grinding said mixed powders into finer ones;

d) compacting said mixed powders to form a green compact;

e) sintering said green compact in a first atmosphere;

f) plastically working and process annealing said green compact;

g) etching a surface of said green compact to cause pores thereon; and h) sintering said etched green compact in an oxidizing atmosphere.

2. A method according to claim 1, wherein said two metals are nickel and chromium.

3. A method according to claim 2, wherein said powders include about 70%~90% Ni and about 30%~10% Cr by weight.

4. A method according to claim 1, wherein said mixing step b) is executed in a ball mill.

5. A method according to claim 1, wherein said compacting step c) is one of cold isostatic compaction, slip casting, vibratory compaction, continuous compaction, powder rolling compaction, powder extrusion and cold die compaction processes.

6. A method according to claim 1, wherein said first atmosphere is an oxidizing atmosphere.

7. A method according to claim 6, wherein said oxidizing atmosphere is one selected from a group consisting of air and oxygen atmospheres.

8. A method according to claim 1, wherein said first atmosphere is one selected from a group consisting of nitrogen-hydrogen, argon and argon-hydrogen atmospheres.

9. A method according to claim 1, wherein said green compact is sintered at a temperature of about 1300° C. and a pressure of about 1 atm for about an hour.

10. A heating element manufactured by said method according to claim 1 having a cermet-type microstructure.

11. A heating element manufactured by said method according to claim 1 having a density of about 80%.

12. A heating element manufactured by said method according to claim 1 having a density over 95%.

13. A heating element manufactured by said method according to claim 1 having a fusion temperature over 1700° C.

* * * * *